US012049805B2

(12) United States Patent
Albertz et al.

(10) Patent No.: US 12,049,805 B2
(45) Date of Patent: Jul. 30, 2024

(54) BOTTOM-UP SEQUESTRATION OF CARBON DIOXIDE IN NEGATIVE GEOLOGIC CLOSURES

(71) Applicant: Saudi Arabian Oil Company, Dhahran (SA)

(72) Inventors: Markus Albertz, The Woodlands, TX (US); Hasmukh A. Patel, Katy, TX (US)

(73) Assignee: Saudi Arabian Oil Company, Dhahran (SA)

( * ) Notice: Subject to any disclaimer, the term of this patent is extended or adjusted under 35 U.S.C. 154(b) by 0 days.

(21) Appl. No.: 18/082,114

(22) Filed: Dec. 15, 2022

(65) Prior Publication Data

US 2024/0200426 A1 Jun. 20, 2024

(51) Int. Cl.
*E21B 41/00* (2006.01)
*E21B 47/003* (2012.01)

(52) U.S. Cl.
CPC ..... *E21B 41/0064* (2013.01); *E21B 47/003* (2020.05)

(58) Field of Classification Search
None
See application file for complete search history.

(56) References Cited

U.S. PATENT DOCUMENTS 6,698,515 B2 3/2004 Karanikas et al.
7,077,199 B2 7/2006 Vinegar et al.
8,002,498 B2 8/2011 Leone et al.
8,176,984 B2 5/2012 Ramakrishnan et al.
8,620,636 B2 12/2013 Zhan et al.
8,899,331 B2 12/2014 Burnham
9,163,499 B2 10/2015 Adams et al.
9,291,541 B2 3/2016 Kim et al.
9,714,406 B2 7/2017 Constantz et al.
9,834,381 B2 12/2017 Wang et al.
10,351,758 B2 7/2019 Hull et al.
10,871,061 B2 12/2020 Hull et al.
11,078,406 B2 8/2021 Hull et al.
11,542,815 B2 1/2023 Hull et al.
(Continued)

FOREIGN PATENT DOCUMENTS

CA 2844919 10/2018
CN 101190743 11/2013
(Continued)

OTHER PUBLICATIONS

Ajayi et al., "A review of CO2 storage in geological formations emphasizing modeling, monitoring and capacity estimation approaches," Petroleum Science, Jul. 8, 2019, 16:1028-1063, 36 pages.
(Continued)

*Primary Examiner* — Anuradha Ahuja
(74) *Attorney, Agent, or Firm* — Fish & Richardson P.C.

(57) ABSTRACT

Methods for storing carbon dioxide in a subsurface formation include identifying a plurality of negative geologic closures in the subsurface formation. The dimensions of the plurality of negative geologic closures are characterized. Layers of subsurface formation in the vicinity the negative geologic closures are characterized. One of the negative geologic closures is selected for bottom-up storage of carbon dioxide based on the characterized dimensions and layers.

15 Claims, 5 Drawing Sheets

(56) References Cited

U.S. PATENT DOCUMENTS

| | | | | |
|---|---|---|---|---|
| 2002/0040177 | A1 | 4/2002 | Maher | |
| 2003/0066647 | A1 | 1/2003 | Abouodah | |
| 2003/0066644 | A1 | 4/2003 | Karanikas | |
| 2006/0018598 | A1 | 1/2006 | Feuer et al. | |
| 2007/0079617 | A1* | 4/2007 | Farmer | F24T 10/20 165/45 |
| 2008/0006410 | A1 | 1/2008 | Looney et al. | |
| 2008/0088171 | A1 | 4/2008 | Cheng | |
| 2008/0319726 | A1* | 12/2008 | Berge | E21B 41/0064 703/10 |
| 2010/0012331 | A1 | 1/2010 | Lader | |
| 2010/0170674 | A1* | 7/2010 | Blount | E21B 41/0064 405/59 |
| 2011/0014100 | A1 | 1/2011 | Bara et al. | |
| 2011/0247814 | A1 | 10/2011 | Karanikas | |
| 2012/0291675 | A1 | 11/2012 | Camire et al. | |
| 2013/0170910 | A1* | 7/2013 | Hoier | B65G 5/00 405/53 |
| 2015/0096755 | A1 | 4/2015 | Martucci et al. | |
| 2017/0066959 | A1 | 3/2017 | Hull et al. | |
| 2019/0211658 | A1 | 7/2019 | Hull et al. | |
| 2021/0024808 | A1 | 1/2021 | Schipper et al. | |
| 2021/0024814 | A1 | 1/2021 | Schipper et al. | |
| 2021/0198558 | A1 | 7/2021 | Hull et al. | |
| 2021/0198559 | A1 | 7/2021 | Hull et al. | |
| 2021/0222055 | A1 | 7/2021 | Schipper et al. | |
| 2022/0170365 | A1 | 6/2022 | Hull et al. | |
| 2023/0183558 | A1 | 6/2023 | Hull et al. | |
| 2024/0018849 | A1 | 1/2024 | Patel et al. | |

FOREIGN PATENT DOCUMENTS

| | | |
|---|---|---|
| EP | 2465603 | 10/2019 |
| JP | 5347154 | 11/2013 |
| WO | WO 2014089185 | 6/2014 |

OTHER PUBLICATIONS

Arti et al., "Single Process for CO2 Capture and Mineralization in Various Alkanolamines Using Calcium Chloride," Energy & Fuels, Dec. 13, 2016, 31(1):763-769, 7 pages.

Arts et al., "Seismic monitoring at the Sleipner underground CO2 storage site (North Sea)," Geological Storage of Carbon Dioxide, Jan. 2004, 233:181-191, 11 pages.

Atlas of Deep-Water Outcrops, vol. 56, Jan. 1, 2008, Chapter 11B—Architecture of a Deep-water, Salt-withdrawal Mini-basin, Donkey Bore Syncline, Australia, 5 pages.

Beyer et al., "Evolution of reservoir properties in the Lower Triassic aquifer sandstones of the Thuringian Syncline in Central Germany," Dissertation submitted to the Friedrich-Schiller-Universität Jena, Apr. 2, 2015, 221 pages.

Bouzalakos et al., "1—Overview of carbon dioxide (CO2) capture and storage technology," Developments and Innovation in Carbon Dioxide (CO2) Capture and Storage Technology, Jun. 2010, 1-24, 24 pages.

Ceglar et al., "Deepwater outcrop analogue study: basal Bunkers Sandstone, Donkey Bore Syncline, Northern Flinders Ranges, Australia," PESA Eastern Australasian Basins Symposium II, Sep. 19-22, 2004, 499-509, 11 pages.

Documents.ieaghg.org [online], "IEAGHG Technical Report—Case Studies of CO2 Storage in Depleted Oil and Gas Fields," Jan. 2017, retrieved on Jan. 31, 2024, retrieved from URL<https://documents.ieaghg.org/index.php/s/83UaPVaoYVD9Mx4>, 172 pages.

Eiken et al., "Lessons learned from 14 years of CCS operations: Sleipner, In Salah and Snøhvit," Energy Procedia, 2011, 4:5541-5548, 8 pages.

Epa.gov [online], "UIC Pressure Falloff Testing Guideline," Aug. 8, 2002, retrieved on Feb. 1, 2024, retrieved from URL <https://www.epa.gov/sites/default/files/2015-07/documents/guideline.pdf>, 29 pages.

Gislason et al., "Carbon Storage in Basalt," Science, Apr. 25, 2014, 344:373-374, 3 pages.

Globalccsinstitute.com [online], "Global Status of CCS 2020," Jan. 28, 2021, retrieved on Jan. 31, 2024, retrieved from URL <https://www.globalccsinstitute.com/wp-content/uploads/2021/09/Global-Status-of-CCS-Report-Jan-28-1.pdf>, 44 pages.

Goeppert et al., "Air as the renewable carbon source of the future: an overview of CO2 capture from the atmosphere," Energy & Environmental Science, 2012, 5:7833-7853, 21 pages.

Hannis et al., "CO2 Storage in Depleted or Depleting Oil and Gas Fields: What can We Learn from Existing Projects?," Energy Procedia, 2017, 114:5680-5690, 11 pages.

Hassanzadeh et al., "Accelerating CO2 Dissolution in Saline Aquifers for Geological Storage—Mechanistic and Sensitivity Studies," Energy & Fuels, Apr. 29, 2009, 23:3328-3336, 9 pages.

Hepburn et al., "The technological and economic prospects for CO2 utilization and removal," Nature, Nov. 6, 2019, 575:87-97, 11 pages.

How to Store CO2 Underground: Insights from early-mover CCS Projects, Irst Ed., Jan. 1, 2020, 141 pages.

Hull et al., "Chemomechanical Effects of Oxidizer-CO2 Systems Upon Hydraulically Fractured Unconventional Source Rock," The Canadian Journal of Chemical Engineering, Jul. 26, 2021, 26 pages.

Hull et al., "Oxidative Kerogen Degradation: A Potential Approach to Hydraulic Fracturing in Unconventionals," Energy & Fuels, 2019, 33:4758-4766, 9 pages.

Hull et al., "Synthesis and structural characterization of CO2-soluble oxidizers [Bu4N]BrO3 and [Bu4N]C1O3 and their dissolution in cosolvent-modified CO2 for reservoir applications," RSC Advances, Dec. 21, 2020, 10:44973-44980, 8 pages.

Hur et al., "Reactive force fields for modeling oxidative degradation of organic matter in geological formations," RSC Advances, Sep. 1, 2021, 11:29298-29307, 10 pages.

IPCC.ch [online], "IPCC Special Report on Carbon Dioxide Capture and Storage," Dec. 19, 2005, retrieved on Feb. 20, 2024, URL <https://www.ipcc.ch/site/assets/uploads/2018/03/srccs_wholereport-1.pdf>, 443 pages.

Kumar et al., "Effect of brine salinity on the geological sequestration of CO2 in a deep saline carbonate formation," Greenhouse Gases Science and Technology, Feb. 11, 2020, 10(2):296-312, 17 pages.

Li et al., "The pore-fracture system properties of coalbed methane reservoirs in the Panguan Syncline, Guizhou, China," Geoscience Frontiers, Feb. 25, 2012, 3(6):853-862, 10 pages.

Loizzo et al., "Reusing O&G-Depleted Reservoirs for CO2 Storage: Pros and Cons," SPE Projects, Facilities & Construction, Sep. 13, 2010, 5(3):166-172, 10 pages.

Majumdar et al., "Research Opportunities for CO2 Utilization and Negative Emissions at the Gigatonne Scale," Joule, May 16, 2018, 2:805-809, 5 pages.

National Academies of Sciences, Engineering, and Medicine, "Negative Emissions Technologies and Reliable Sequestration: A Research Agenda (2019)," Washington, DC: The National Academies Press, 2019, 511 pages.

Patel et al., "Carbon Dioxide Capture Adsorbents: Chemistry and Methods," ChemSusChem, 2017, 10: 1303-1317, 16 pages.

Pau et al., "High-resolution simulation and characterization of density-driven flow in CO2 storage in saline aquifers," Advances in Water Resources, Apr. 4, 2010, 33(4):443-455, 13 pages.

Power et al., "Accelerating Mineral Carbonation Using Carbonic Anhydrase," Environ. Sci. Technol., Feb. 1, 2016, 50(5):2610-2618, 9 pages.

Rahimi et al., "Toward smart carbon capture with machine learning," Cell Reports Physical Science, Apr. 21, 2021, 2(4):1-19, 19 pages.

Reeve et al., "Carbonate geochemistry and the concentrations of aqueous Mg2+, Sr2+ and Ca2+: Western north coast of the Yucatan, Mexico," Chemical Geology, Jan. 1994, 112(1-2): 105-117, 13 pages.

Sanna et al., "A review of mineral carbonation technologies to sequester CO2," Chem. Soc. Rev., Jul. 1, 2014, 43(23):8049-8080, 32 pages.

(56) References Cited

OTHER PUBLICATIONS

Sequestration.mit.edu [online], "Polk Station Fact Sheet: Carbon Dioxide Capture and Storage Project," Jul. 2010, retrieved on May 3, 2022, retrieved from URL <https://sequestration.mit.edu/tools/projects/polk.html>, 2 pages.

Tang et al., "Experimental Study on the Density-Driven Carbon Dioxide Convective Diffusion in Formation Water at Reservoir Conditions," ACS Omega, Jun. 25, 2019, 4:11082-11092, 11 pages.

Thanh et al., "Application of artificial neural network for predicting the performance of CO2 Enhanced oil recovery and storage in residual oil zones," Scientific Reports, Oct. 2020, 10(18204):1-16, 16 pages.

Tong et al., "Committed Emissions from Existing Energy Infrastructure Jeopardize 1.5 Climate Target," Nature, 2019, 572(7769): 373-377, 17 pages.

U.S. Appl. No. 63/289,308, Hull et al., Negative Carbon City Grid for Capture and Sequestration of Carbon Dioxide in Subterranean Formations, filed Dec. 14, 2021, 56 pages.

Wang et al., "Impacts of mineralogical compositions on different trapping mechanisms during long-term CO2 storage in deep saline aquifers," Acta Geotechnica, Jan. 23, 2016, 11:1167-1188, 22 pages.

Wang et al., "Molecular Simulation of CO2/CH4 Competitive Adsorption on Shale Kerogen for CO2 Sequestration and Enhanced Gas Recovery," J. Phys. Chem. C, Jul. 10, 2018, 122(30):17009-17018, 29 pages.

Weir et al., "Reservoir storage and containment of greenhouse gases," Energy Convers. Mgmt., June-Sep. 1995, 36(6-9):531-534, 4 pages.

Zhang et al., "Effectiveness of amino acid salt solutions in capturing CO2: A review," Renewable and Sustainable Energy Reviews, 2018, 98:179-188, 10 pages.

Zhang et al., "Rapid CO2 capture-to-mineralisation in a scalable reactor," React. Chem. Eng., Jan. 21, 2020, 5(3):473-484, 18 pages.

* cited by examiner

BOTTOM-UP SEQUESTRATION OF CARBON DIOXIDE IN NEGATIVE GEOLOGIC CLOSURES

TECHNICAL FIELD

This disclosure relates to sequestering carbon dioxide in subsurface formations, particularly in negative geologic closures.

BACKGROUND

Carbon dioxide is the most commonly produced greenhouse gas. Carbon sequestration is the process of capturing and storing carbon dioxide. It is one method of reducing the amount of carbon dioxide in the atmosphere with the goal of reducing global climate change. In one approach, captured carbon dioxide is stored in underground geologic formations. The carbon dioxide can be pressurized until it becomes a liquid before being injected into porous rock formations in geologic basins.

SUMMARY

This specification describes methods and systems for sequestering carbon dioxide in subsurface formations, particularly in negative geologic closures. After identifying a plurality of negative geologic closures in the subsurface formation, the dimensions of the plurality of negative geologic closures and the layers of subsurface formation in the vicinity the negative geologic closures are characterized. One of the negative geologic closures is selected based on the characterized dimensions and layers and an injection well is positioned in the selected negative geologic closure. After completion, the well is used to discharging a fluid comprising carbon dioxide through the injection well into the selected negative geologic closure. This approach can also include increasing the density of fluid containing carbon dioxide so that it is biased to naturally remaining in the negative geologic closure where it is discharged.

Upon injection into deep geological formations, such as depleted oil and gas fields and saline aquifers, carbon dioxide can be trapped through either physical or geochemical trapping mechanisms. Physical trapping mechanisms include static (structural and stratigraphic), hydrodynamic, and residual gas trapping. These mechanisms initially trap carbon dioxide upon injection as geochemical trapping mechanisms take considerable time to become effective. However, geochemical trapping results in more permanent and secure storage of carbon dioxide and is hence preferable to physical trapping. The two types of geochemical trapping are solubility and mineral trapping.

Solubility trapping involves carbon dioxide dissolving in the local brine and becoming trapped as an aqueous component. The aqueous carbon dioxide then reacts with water to form carbonic species. The concentration of each of the three carbonic species, $H_2CO_3$, $HCO_3^-$ and $CO_3^{2-}$, is dependent on the brine pH. $H_2CO_3$ is the primary species at low pH (~4), $HCO_3^-$ dominates at the near neutral (~6), and $CO_3^{2-}$ species are prevalent at basic pH (~9).

Negative geologic closures are portions of a subsurface formation where a layer which limits flow of fluids through the formation generally has a lower central region defined by higher edges. Negative geologic closures tend to collect fluids that have a higher density (e.g., brine) than other fluids (e.g., fresh water) in the formation. In contrast, positive geologic closures are portions of a subsurface formation where a layer which limits flow of fluids through the formation generally has a higher central region defined by lower edges. Positive geologic closures tend to collect fluids that have a lower density (e.g., oil and gas) than other fluids (e.g., water) in the formation.

In one aspect, methods of storing carbon dioxide in a subsurface formation include: identifying a plurality of negative geologic closures in the subsurface formation; characterizing dimensions of the plurality of negative geologic closures; characterizing layers of subsurface formation in the vicinity the negative geologic closures; selecting one of the negative geologic closures based on the characterized dimensions and layers; positioning an injection well in the selected negative geologic closure; and discharging a fluid comprising carbon dioxide through the injection well into the selected negative geologic closure. Embodiments of these methods can include one or more of the following features.

In some embodiments, the negative geologic closure includes multiple layers of the subsurface formation. In some cases, positioning the injection well in the selected negative geologic closure comprises positioning the injection well at the bottom layer of the negative geologic closure. Some methods also include repositioning the injection well in a higher layer after carbon dioxide saturation pressure is reached in a current layer.

In some embodiments, discharging the fluid comprising carbon dioxide comprises discharging a carbon dioxide—water mixture. In some cases, discharging the carbon dioxide—water mixture comprises discharging a carbon dioxide—brine mixture.

In some embodiments, discharging the fluid comprising carbon dioxide comprises discharging liquid carbon dioxide.

In some embodiments, discharging the fluid comprising carbon dioxide comprises injecting carbon dioxide at a pressure between 14.5 and 35,000 psi.

In some embodiments, identifying the plurality of negative geologic closures in the subsurface formation comprises identifying the plurality of negative geologic closures in the subsurface formation based at least in part on seismic data. In some cases, methods also include acquiring a seismic survey.

In some embodiments, selecting one of the negative geologic closures comprises selecting a negative geologic closure with a temperature between 50 and 75° C.

In some embodiments, selecting one of the negative geologic closures comprises selecting a negative geologic closure where formation pressure is between 2,000 and 10,000 psi. In some cases, selecting one of the negative geologic closures comprises selecting a negative geologic closure with a porosity of between 5 and 25% in the storage formations. In some cases, selecting one of the negative geologic closures comprises selecting a negative geologic closure with a permeability between 5-50 millidarcy in the storage formations.

Currently carbon capture and sequestration typically begins with removing carbon dioxide from a flue gas through pre-, post- or oxyfuel-combustion. Once the carbon dioxide has been captured it needs to be stored in a safe and permanent manner. Although carbon dioxide storage within depleted oil and gas fields or deep saline aquifers takes advantage of their large storage capacities and existing infrastructure, the need for long term carbon storage is anticipated to eventually exceed the storage provided by these resources. In addition, the reservoirs associated with conventional oil and gas traps formed by positive closures can also be used for carbon dioxide sequestration as the oil and gas are depleted (e.g., through enhanced oil or gas recovery operations).

The methods and systems described in this specification focus on negative geological closures. However, the exact placement of carbon dioxide or carbon dioxide-concentrated fluids in these structures is important to utilize their full storage potential.

This approach can provide one or more of the following advantages. This approach eliminates potential wellbore stability issues and associated carbon dioxide leakage from existing wells in and above the reservoir by using geologic structures from which oil and gas is typically not produced. By employing in-situ injection rather than discharging carbon dioxide at the top of a reservoir and allowing it to migrate downward, this approach decreases the migration distance for carbon dioxide from the injection site to its final repository. By utilizing negative geologic closures to hold densified carbon dioxide fluids, this approach avoids potential cap rocks or seal integrity issues that can occur due to buoyancy pressures that can occur with less dense fluids. By using closed container-type geometries in negative geologic closures, this approach can provide long-term trapping of carbon dioxide within salt-rich water allowing sufficient time for carbon mineralization in the formation.

In existing carbon dioxide sequestration projects (which generally involve positive closures), injection is typically performed near the top or somewhere in the middle of the reservoir. Since carbon dioxide is still buoyant under these circumstances, the gas tends to migrate upwards, where it gets trapped at the reservoir-seal interface and forms a plume (Arts et al., 2004). This approach may result in incomplete filling of the reservoir, as the detailed migration pathway and connectivity among reservoir interlayers are difficult to predict ahead of time. In contrast, the approach described in this specification uses a more controlled injection method in which the available storage space is systematically filled from the bottom up.

The details of one or more embodiments of the invention are set forth in the accompanying drawings and the description below. Other features, objects, and advantages of the invention will be apparent from the description and drawings, and from the claims.

DESCRIPTION OF DRAWINGS

Like reference symbols in the various drawings indicate like elements.

DETAILED DESCRIPTION

This specification describes methods and systems for sequestering carbon dioxide in subsurface formations, particularly in negative geologic closures. After identifying a plurality of negative geologic closures in the subsurface formation, the dimensions of the plurality of negative geologic closures and the layers of subsurface formation in the vicinity the negative geologic closures are characterized. One of the negative geologic closures is selected based on the characterized dimensions and layers and an injection well is positioned in the selected negative geologic closure. After completion, the well is used to discharging a fluid comprising carbon dioxide through the injection well into the selected negative geologic closure. This approach can also include increasing the density of fluid containing carbon dioxide so that it is biased to naturally remaining in the negative geologic closure where it is discharged.

Figure 1:
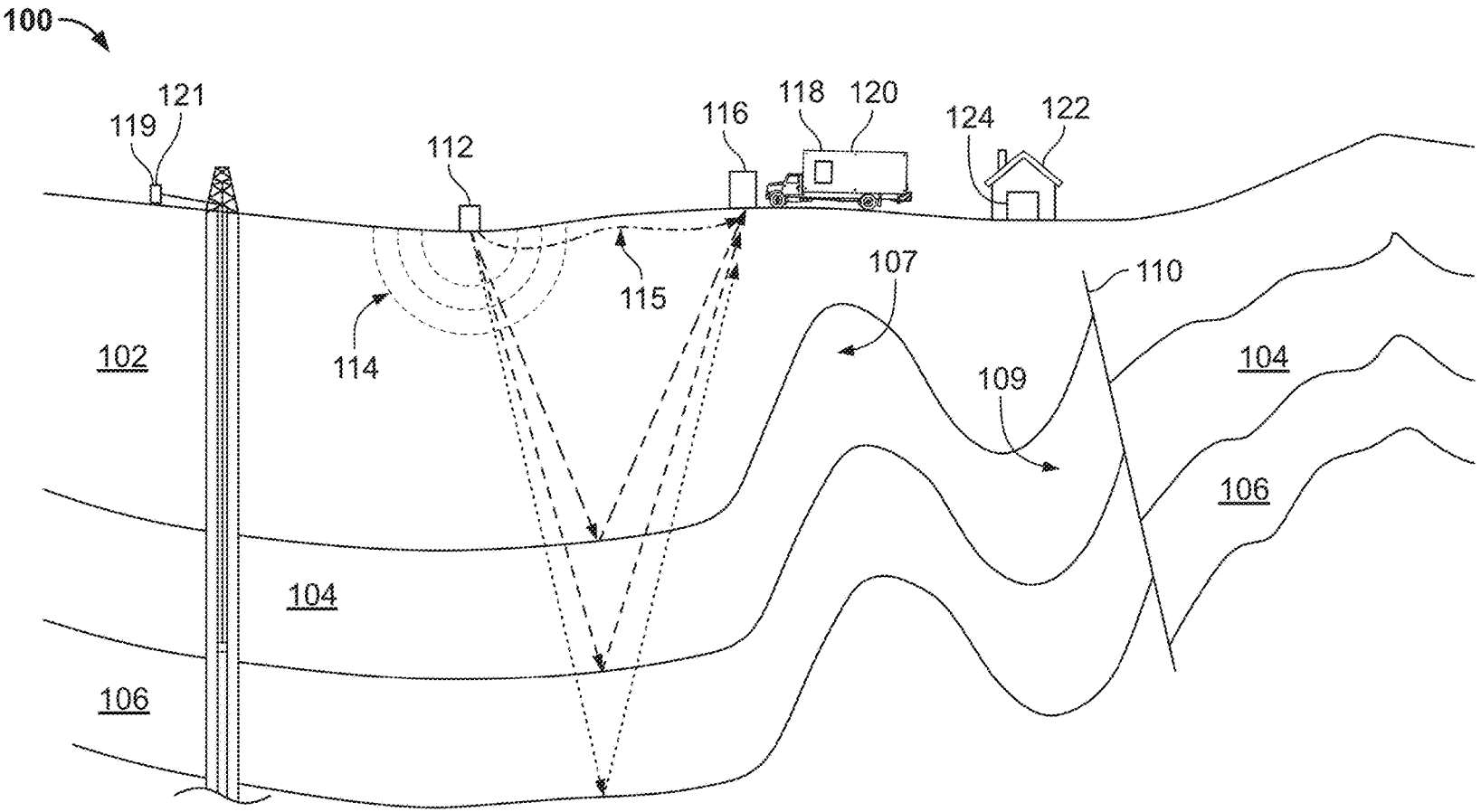
FIG. 1 is a schematic view of exploration processes being used to characterize a subsurface formation to identify negative geologic closures.

FIG. 1 is a schematic view of processes being used to characterize a subsurface formation 100 to identify negative geologic closures. Facies underlying the impermeable cap rocks 102 include a sandstone layer 104, and an intermediate impermeable layer 106. A fault line 110 extends across the sandstone layer 104 and the intermediate impermeable layer 106. As illustrated, layers form a positive geologic closure 107 (sometimes referred to as an anticline trap) and a negative geologic closure 109.

Oil and gas tend to rise through permeable reservoir rock until further upward migration is blocked, for example, by the layer of impermeable cap rock 102. Seismic surveys are typically performed to attempt to identify locations where interaction between layers of the subsurface formation 100 are likely to trap oil and gas by limiting this upward migration (e.g., the anticline trap 107, where the layer of impermeable cap rock 102 has an upward convex configuration. However, the data from seismic surveys and other exploration activities can be used to identify potential negative geologic closures (e.g., negative geologic closure 109) and then, if necessary, more detailed investigations can be performed that focus on the potential negative geologic closures.

Seismic surveys use a seismic source 112 (for example, a seismic vibrator or an explosion, or an array of air guns in offshore settings) generates seismic waves that propagate in the earth. Although illustrated as a single component in FIG. 1, the source or sources 112 are typically a line or an array of sources 112. The generated seismic waves include seismic body waves 114 that travel into the ground and seismic surface waves 115 travel along the ground surface and diminish as they get further from the surface.

The velocity of these seismic waves depends properties, for example, density, porosity, and fluid content of the medium through which the seismic waves are traveling. Different geologic bodies or layers in the earth are distinguishable because the layers have different properties and, thus, different characteristic seismic velocities. For example, in the subsurface formation 100, the velocity of seismic waves traveling through the subsurface formation 100 will be different in the sandstone layer 104, the intermediate impermeable layer 106, and the sand layer. As the seismic body waves 114 contact interfaces between geologic bodies or layers that have different velocities, each interface reflects some of the energy of the seismic wave and refracts some of the energy of the seismic wave.

The seismic body waves 114 are received by a sensor or sensors 116. Although illustrated as a single component in FIG. 1, the sensor or sensors 116 are typically a line or an array of sensors 116 that generate an output signal in response to received seismic waves including waves reflected by the horizons in the subsurface formation 100. The sensors 116 can be geophone-receivers that produce electrical output signals transmitted as input data, for example, to a computer 118 on a seismic control truck 120. Based on the input data, the computer 118 may generate a seismic data output, for example, a seismic two-way response time plot.

The seismic surface waves 115 travel more slowly than seismic body waves 114. Analysis of the time it takes seismic surface waves 115 to travel from source to sensor can provide information about near surface features.

A control center 122 can be operatively coupled to the seismic control truck 120 and other data acquisition systems 124 and wellsite systems. The control center 122 may have computer facilities for receiving, storing, processing, and analyzing data from the seismic control truck 120 and other data acquisition and wellsite systems that provide additional information about the subsurface formation. For example, the control center 122 can receive data from a computer 119 associated with a well logging unit 121. The well logging unit 121 can be used to obtain detailed information about the different layers of the subsurface formation at specific locations.

Figure 2A:
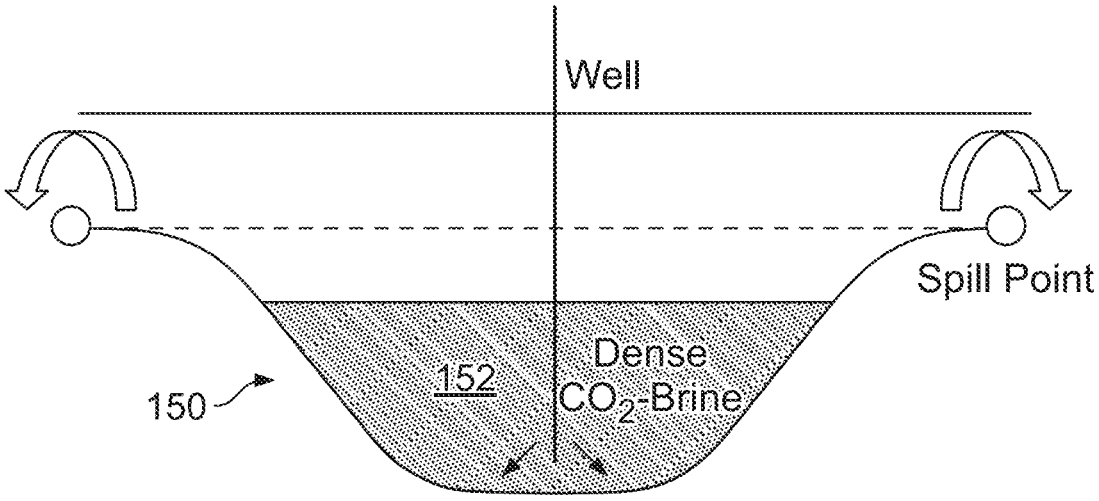
FIGS. 2A and 2B are schematic views illustrating the bottom-up injection of densified carbon dioxide into the bottom section of a negative closure containing an idealized geologic formation with uniform properties.
Figure 2B:
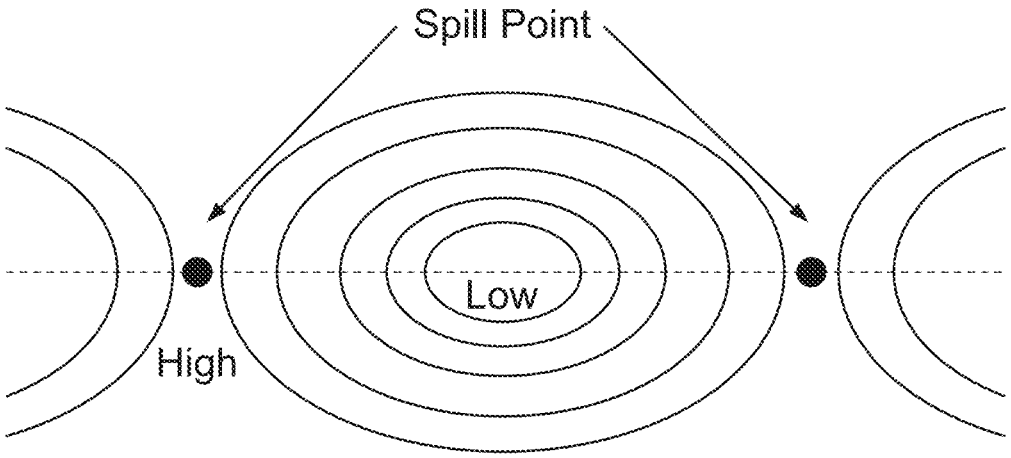

FIGS. 2A and 2B are schematic views illustrating the bottom-up injection of densified carbon dioxide into the bottom section of a negative closure 150 containing an idealized geologic formation with uniform properties. A densified carbon dioxide-brine 152 is being injected into the bottom section of the negative closure 150. The region below the closure is assumed to be impermeable. Although the negative buoyant pressure of densified carbon dioxide-brine will act downward, carbon dioxide will be contained within the closure. With time, the fluid will fill the closure from the bottom up until it reaches the spill point, where it spills over into an adjacent structure. The dashed line in FIG. 2A depicts the ultimate spill level. FIG. 2B is a map view of depth contour lines illustrating the negative closure 150 with a dashed line showing the position of cross section of FIG. 2A.

Densified carbon dioxide brine is generated through dissolution of carbon dioxide in water, mixing of formation water with highly saline water, and/or mixing water with other available densifying additives, for example as gels and fines. The carbon dioxide dissolution results in a 2-3% density increase of brines, which is sufficient to trigger negative buoyancy and hence sinking (Tang et al, 2019). Densifying additives may include barite, hematite, calcium carbonate, siderite, gels, fines, or combinations thereof. Specific proportions of densifying additives are variable because they are subject to the starting ranges.

Figure 3:
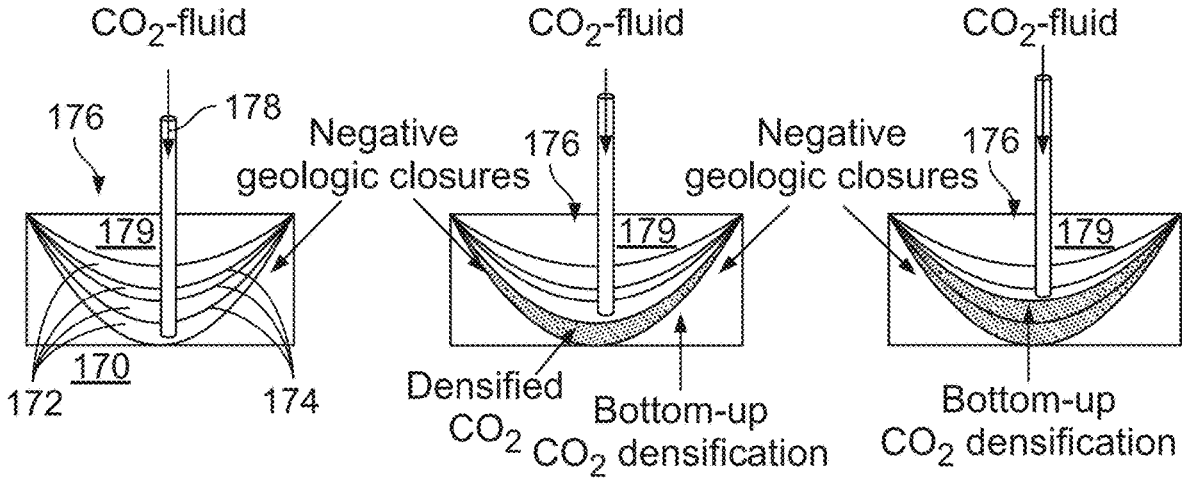
FIG. 3 is a schematic view illustrating a more realistic scenario in which the subsurface formation has alternating layers of permeable and impermeable rocks.

FIG. 3 is a schematic view illustrating a more realistic scenario in which the subsurface formation 170 has alternating layers of permeable 172 and impermeable 174 rocks in the negative closure 176. Only the permeable layers 172 are filled. The impermeable layers 174 are denoted by black lines, representing thin impermeable layers. Closures with alternating layers of permeable 172 and impermeable 174 rocks behave like a closed container with alternating layers of high-permeability reservoir and low-permeability seal offering leakage proof carbon dioxide storage.

Although the wellbore 178 is illustrated as being raised through the subsurface formation 179, the wellbore and casing will typically remain in place with packers being used to isolate lower portions of the wellbore and new perforations being formed at the depth of desired injection. This approach of bottom-up carbon dioxide storage uses the full potential of space available in the negative closure 176 for carbon dioxide storage.

Typical ranges of parameters found in negative closures include: size of 10s to 100s of kilometers; thickness of 10s to 100s of meters; porosity between 3 and 26%; permeability of 0 to 110 mD; and temperature of 20 to 375° C. (assuming an average geothermal gradient of 25° C./km and considering depths from 0.8 to 15 km). These are typical ranges occurring in nature. Exact combinations of parameters are site-specific and subject to characterization. Any combinations of these ranges are expected to work. A few selected examples of naturally occurring negative geologic structures and their dimensions are listed in Table 1.

TABLE 1

Examples of negative geologic structures (Beyer, 2015, Ceglar et al., 2004, Li et al., 2012, Payenberg et al., 2008).

| | | Reservoir | | | | |
|---|---|---|---|---|---|---|
| Structure | Area [km$^2$] | Type | # of Layers | Thickness [m] | Porosity [%] | Permeability [mD] |
| Thuringian Syncline (Germany) | 10,500 (70 × 150) | Sandstone | 4 | 18-236 | 11.5-13.4 | 4.1-108.7 |
| Panguan Syncline (China) | 540 (16 × 45) | Coal | 11-20 | 30-42 | 2.8-7.9 | 0.2-14.7 |
| Donkey Bore Syncline (Australia) | 22 (3.5 × 6.3) | Sandstone | 7 | 30-90 | 26 | Not reported |

Figure 4:
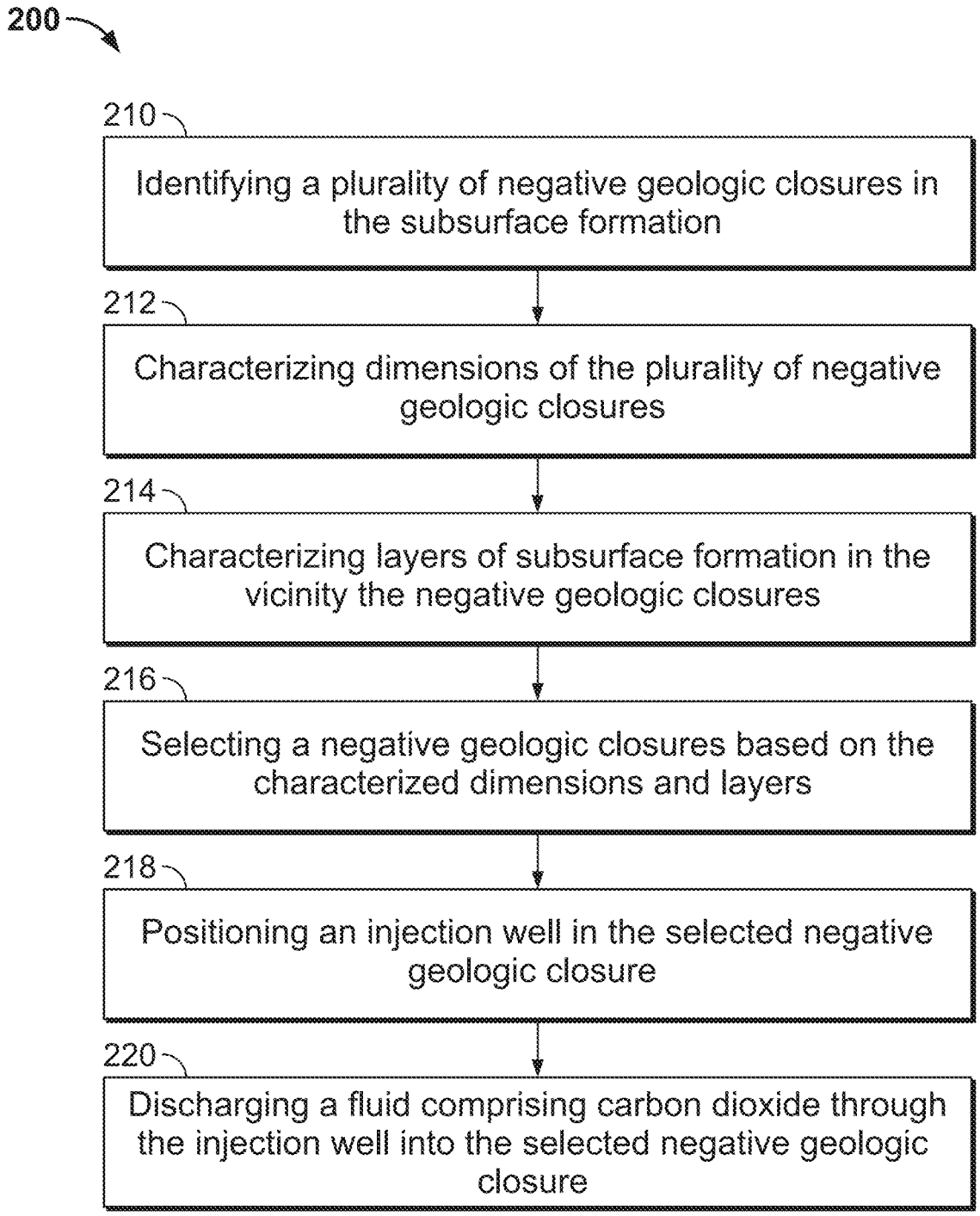
FIG. 4 is a plot of modeling results illustrating negatively buoyant carbon dioxide-brine fingers to sink to the bottom of a reservoir as carbon dioxide dissolution in formation water increases the fluid density.

FIG. 4 is a flowchart illustrating a method 200 of sequestering carbon dioxide. The method 200 includes identification and mapping of negative geology closures to estimate theoretical carbon dioxide storage capacity. A plurality of negative geologic closures in the subsurface formation are initially identified (step 210). The identification can be based previously obtained data including, for example, seismic data, well logging data, pressure data, conventional core, rotary sidewall core, drilling cuttings, and fluid samples. In some cases, additional data gathering (e.g., a seismic survey focusing on a potentially useful negative closure) may be performed.

The identified negative geologic closures are then assessed for potential use in carbon dioxide storage with the dimensions and characteristics of these closures documented. The dimensions of the plurality of negative geologic closures are characterized (step 212), for example, with respect to depth, length, and number of layers. Similarly, the layers themselves are characterized (step 214), for example, with respect to porosity, permeability, temperature, pressure, and chemical composition of trapped fluids and formation). Both the layers of the identified negative closure and other nearby portions of the subsurface formation are typically characterized. Parameters including length, depth, and porosity can be used estimate potential storage volume of the identified negative closures. Parameters including temperature, pressure, and chemical composition of trapped fluids and formation can be used to assess the extent and timing of mineralization of the carbon dioxide.

After the potential negative closures are assessed, one or more of them are selected based on the characterized layers (step 216). Selecting a negative geologic closure with a temperature between 50 and 75° C. and where surrounding formation is between 2,000 and 10,000 psi because higher pressure enhances the CO2 solubility in formation water. Selecting a negative geologic closure with a porosity of between 5 and 25% can provide adequate storage volume. Higher porosity provides high storage volume. Selecting a negative geologic closure with a permeability between 5-50 millidarcy can adequate fluid flow to allow the filling-up accessible pore volumes with carbon dioxide-rich brine in the storage zones.

One or more injection wells are then positioned in the selected formation(s) (step 218). Positioning the well(s) will typically include drilling the well(s) to the bottom layer of the selected negative closure before casing the well and perforating the casing in the bottom layer. When there are multiple layers, the well can be repositioned in a higher layer after carbon dioxide saturation pressure is reached in a current layer. The saturation can be monitored, for example, by time lapse seismic surveying. To begin filling the next higher layer, the portion of the well below the new layer can be filled with cement or isolated using packers before the casing is perforated in the new layer.

After the well is installed, a fluid including carbon dioxide is discharged through the injection well into the selected negative geologic closure (step 220). The fluid can be a carbon dioxide—water mixture, dissolved carbon dioxide in water (e.g., sea water, high salinity water, brines, or combination of these), liquid carbon dioxide or a supercritical phase. The pressures used can range from 14.5 to 35,000 psi (e.g., 100 to 25,000 psi or 500-10,000 psi).

After injection, pressure in the well is allowed to drop to facilitate the permeation of carbon dioxide into and storage of carbon dioxide in the bottom negative closure.

Theoretical studies of carbon dioxide injection into geologic formations predict that, due to its lower density and immiscibility, carbon dioxide will initially float to the top of the reservoir. After a period of time, carbon dioxide dissolves into the brine, thus increasing the brine density causing the brine to descend under gravity (Pau et al., 2010, Weir et al., 1995). Upward filling of a geologic formation with buoyant carbon dioxide has been confirmed at the Sleipner carbon dioxide storage site in the North Sea, a pilot project which began in 1996 (Arts et al., 2004, Eiken et al., 2011).

Figure 5:
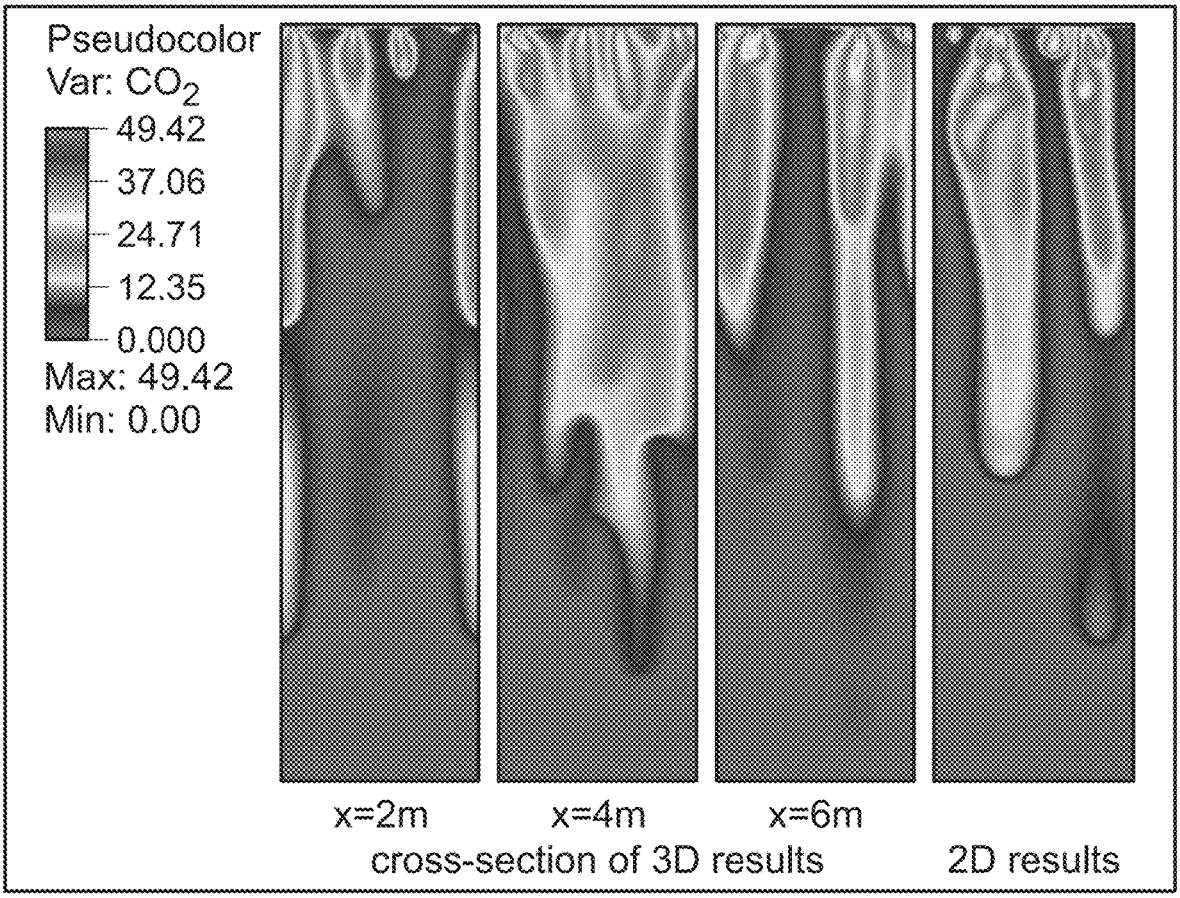
FIG. 5 is a flowchart illustrating a method of sequestering carbon dioxide.

FIG. 5 is a plot of modeling results illustrating this situation with negatively buoyant carbon dioxide-brine fingers to sink to the bottom of a reservoir as carbon dioxide dissolution in formation water increases the fluid density.

Comparing these results with FIG. 3 illustrates the advantages of the bottom-up injection described in this specification.

A number of embodiments of these methods and systems have been described. Nevertheless, it will be understood that various modifications may be made without departing from the spirit and scope of these methods and systems. Accordingly, other embodiments are within the scope of the following claims.

What is claimed is:

1. A method of storing carbon dioxide in a subsurface formation, the method comprising:

(a) identifying a plurality of negative geologic closures in an area of the subsurface formation;

(b) characterizing dimensions of the plurality of negative geologic closures;

(c) characterizing layers of the area of the subsurface formation;

(d) selecting one of the negative geologic closures based on the characterized dimensions and layers;

(e) positioning an injection well at a bottom layer of the selected negative geologic closure; and (f) discharging a fluid comprising carbon dioxide through the injection well into the bottom layer of the selected negative geologic closure;

(g) in response to determining that the bottom layer of the selected negative geologic closure has reached a saturation pressure for the carbon dioxide:

selecting a second layer of the selected negative geologic closure higher than the bottom layer;

isolating a portion of the injection well below the second layer; and discharging the fluid comprising carbon dioxide through the injection well into the second layer of the selected negative geologic closure.

2. The method of claim 1, wherein the selected negative geologic closure includes multiple layers of the area of the subsurface formation.

3. The method of claim 1, wherein discharging the fluid comprising carbon dioxide, in step (f), (g), or both, comprises discharging a carbon dioxide and water mixture.

4. The method of claim 3, wherein discharging the carbon dioxide and water mixture comprises discharging a carbon dioxide and brine mixture.

5. The method of claim 1, wherein discharging the fluid comprising carbon dioxide, in step (f), (g), or both, comprises discharging liquid carbon dioxide.

6. The method of claim 1, wherein discharging the fluid comprising carbon dioxide, in step (f), (g), or both, comprises injecting carbon dioxide at a pressure between 14.5 and 35,000 psi.

7. The method of claim 1, wherein identifying the plurality of negative geologic closures in step (a) comprises identifying the plurality of negative geologic closures based at least in part on seismic data.

8. The method of claim 7, further comprising performing a seismic survey.

9. The method of claim 1, wherein selecting one of the negative geologic closures in step (d) comprises selecting a negative geologic closure with a temperature between 50 and 75° C.

10. The method of claim 1, wherein selecting one of the negative geologic closures in step (d) comprises selecting a negative geologic closure where the pressure in the area of the subsurface formation is between 2,000 and 10,000 psi.

11. The method of claim 1, wherein selecting one of the negative geologic closures in step (d) comprises selecting a negative geologic closure with a porosity of between 5 and 25%.

12. The method of claim 11, wherein selecting one of the negative geologic closures in step (d) comprises selecting a negative geologic closure with a permeability between 5-50 millidarcy.

13. The method of claim 1, further comprising perforating casing of the injection well at the second layer of the selected negative geologic closure.

14. The method of claim 1, wherein isolating the portion of the injection well below the second layer in step (g) comprises using packers to isolate the portion of the injection well.

15. The method of claim 1, wherein isolating the portion of the injection well below the second layer in step (g) comprises filling the portion of the injection well with cement.

* * * * *